US006679644B1

(12) United States Patent
Heller

(10) Patent No.: US 6,679,644 B1
(45) Date of Patent: Jan. 20, 2004

(54) UNIVERSAL, INHERENTLY-TENSILE CONNECTION AND CONSTRUCTION SYSTEM, APPARATUS, METHOD AND PRODUCT-BY-PROCESS

(76) Inventor: Eric Heller, 75 States Rd., Stony Creek, NY (US) 12878

( * ) Notice: Subject to any disclaimer, the term of this patent is extended or adjusted under 35 U.S.C. 154(b) by 0 days.

(21) Appl. No.: 09/683,732

(22) Filed: Feb. 7, 2002

Related U.S. Application Data

(60) Provisional application No. 60/267,915, filed on Feb. 9, 2001.

(51) Int. Cl.[7] ..... F16D 1/00; A63F 9/08

(52) U.S. Cl. ..... 403/220; 403/171; 52/653.2; 52/655.1; 135/127; 434/83; 273/159

(58) Field of Search ..... 403/220–223, 403/225, 228–229, 171; 52/653.2, 655.1; 135/124; 248/303; 434/83; 273/159

(56) References Cited

U.S. PATENT DOCUMENTS

| | | | | |
|---|---|---|---|---|
| 3,422,565 A | | 1/1969 | Kentfield et al. | |
| 3,695,617 A | * | 10/1972 | Mogliner et al. | 273/156 |
| 3,830,011 A | | 8/1974 | Ochrymowich | |
| 3,998,003 A | | 12/1976 | Rosenbaum | |
| 4,404,240 A | | 9/1983 | Varela | |
| 4,421,356 A | * | 12/1983 | Singer | 297/16.1 |
| 4,583,956 A | | 4/1986 | Nelson | |
| 4,614,502 A | * | 9/1986 | Nelson | 446/119 |
| 4,731,962 A | | 3/1988 | Kittner et al. | |
| 4,819,402 A | | 4/1989 | Schneider | |
| 5,116,193 A | | 5/1992 | Takizawa et al. | |
| 5,322,334 A | * | 6/1994 | Hammer | 294/19.1 |
| 5,365,715 A | | 11/1994 | Steinmetz et al. | |
| 5,367,852 A | * | 11/1994 | Masuda et al. | 52/651.06 |
| 5,423,341 A | * | 6/1995 | Brady | 135/139 |
| 5,430,989 A | | 7/1995 | Jones | |
| 5,553,648 A | * | 9/1996 | Goharjou | 160/135 |
| 5,690,446 A | | 11/1997 | Poissant et al. | |
| 5,785,529 A | | 7/1998 | Hearn et al. | |
| 5,930,971 A | * | 8/1999 | Etheridge | 52/646 |
| 6,038,802 A | * | 3/2000 | Tidwell | 40/610 |
| 6,146,050 A | | 11/2000 | Marshall | |

OTHER PUBLICATIONS

"Soda Straw Tensegrity Structures" [online], [retrieved on May 27, 2003 □□]. Retrieved from the Internet <URL:http://www.georgehart.com/virtual–polyhedra/straw–tensegrity.html>.*

Miller, Stephen U.S. patent application Publication US 2002/0153034 App. No. 09/841,649 Filed Apr. 23, 2001.*

* cited by examiner

*Primary Examiner*—Lynne H. Browne
*Assistant Examiner*—Jori Schiffman
(74) *Attorney, Agent, or Firm*—Jay R. Yablon

(57) ABSTRACT

A modular elongated element (1), an intramodule tensile device (11), a pair of securing and linking devices (12), and an intermodule connector device (13), interconnected using the devices and methods disclosed herein, are used to construct a virtually limitless variety of inherently-tensile constructs. In the most elemental module, the intramodule tensile device (11) connects a pair of securing and linking devices (12) which are in turn secured to two ends (14) of the modular elongated element (1).

50 Claims, 6 Drawing Sheets

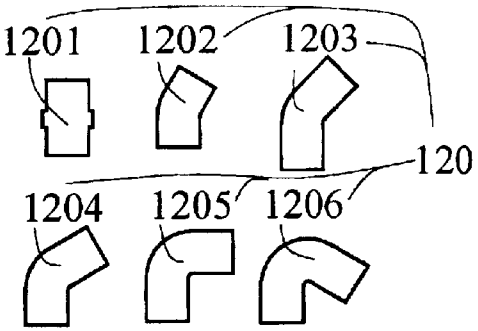
FIG. 12
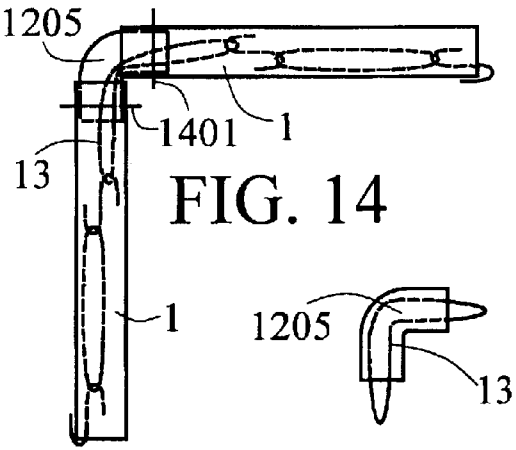
FIG. 14
FIG. 13
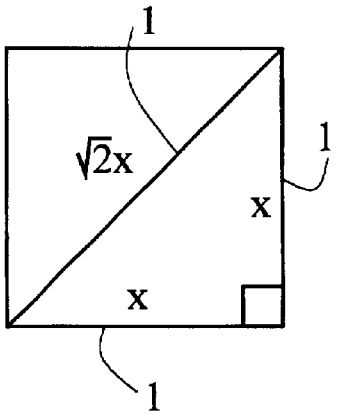
FIG. 10
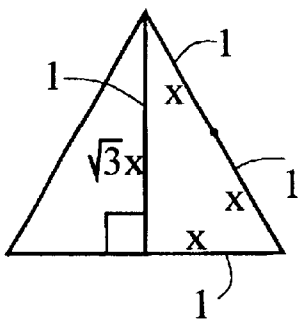
FIG. 11
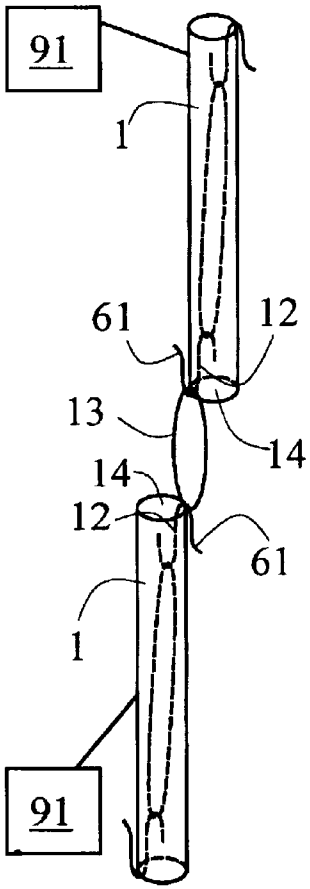
FIG. 9

UNIVERSAL, INHERENTLY-TENSILE CONNECTION AND CONSTRUCTION SYSTEM, APPARATUS, METHOD AND PRODUCT-BY-PROCESS

CROSS REFERENCE TO RELATED APPLICATIONS

This application claims the benefit of U.S. Provisional Application No. 60/267,915, filed Feb. 9, 2001.

BACKGROUND OF INVENTION

This invention relates to the field of modular joints and connectors, and in particular, to the joinder of elongated rod elements with flexible, universally-configurable joints in a manner that ensures tensile integrity.

Modular elongated elements such as rods, tubes, poles, pipes, struts and the like are often joined together into more complicated constructs, using a wide variety of joints between adjacent such modular elongated elements. In some situations, it is desired to connect a plurality of these modular elongated elements end to end so as to create a longer elongated construct, for example, elongated poles used to pitch a tent. In other situations, it is desired to join two or more such modular elongated elements at a vertex in such a way that the vertex angle formed between adjacent modular elongated elements is other than 180 degrees (i.e., the elements are not end to end), and is flexible over a continuous range of angles and not fixed to any predetermined angle. This is useful in a wide range of construction and framing applications, and also for toys and educational demonstrations. For example, the joining of modular elongated elements is frequently used to model various polyhedral constructs illustrating mathematical and scientific concepts.

The problem is that virtually all devices and methods known in the art for joining modular elongated elements utilize complex joints which are frequently limited because they impose fixed, predetermined angles between adjacent modular elongated elements, and / or because they limit the number of modular elongated elements that can be joined together at any given vertex to a specific predetermined number, or to a specific maximum number, and / or because these joints are made only through a complicated and time-consuming series of interconnections steps, and / or because the resulting constructs do not possess sufficient structural integrity to hold together well under stresses applied to them. Additionally, many joints are typically fairly complex elements in and of themselves, requiring various tools for assembly.

For example, U.S. Pat. No. 3,830,011 restricts the number of struts, and relative angles of struts, which may be joined any given vertex because of the various connector pieces such as are shown in FIGS. 21 through 32. U.S. Pat. No. 3,998,003 similarly restricts strut numbers and angles at a vertex by the structure of the linking members (12) therein. The same limitations are imposed by the linkages used in, for example, U.S. Pat. Nos. 4,819,402; 5,116,193; 5,430,989; 5,690,446; and 6,146,050.

While U.S. Pat. No. 5,785,529 does not appear to restrict the numbers and angles of rods that can be connected at a given vertex, it does not provide any tensile or other structural integrity for the constructs that it is used to form, since the rods (12) are easily pulled out from the connectors (10). Additionally, it appears that over time, with enough puncturing, connectors (10) will become degraded and need to be replaced.

The rod tying apparatus in U.S. Pat. No. 5,365,715 exemplifies an extremely complicated system of rod interconnection, and is certainly not desirable or applicable to a broad range of circumstances.

Tensile integrity constructs, and / or constructs utilizing flexible connectors, are a preferred way to provide structural integrity and well as, in some instances, flexibility insofar as the numbers and angles of rods that can be interconnected at a given vertex. Even here, however, the prior art contains serious limitations.

U.S. Pat. No. 3,422,565, for example, uses tubes, plugs and resilient links. However, the insertion of plugs into the tubes, and the connection of the resilient links to the plugs, is rather complex. Further, the links themselves are complex, as can be observed from the transverse slicing (18) and joining (21) shown in FIGS. 4 and 5 and described in column 2, lines 37 55. Depending on the particular structure and orientation of adjacent rods, tensile integrity may also be lacking, as it depends in part on the plugs (12) remaining firmly within the tubes (11), and thus on the frictional forces between the plugs (12) and tubes (11).

U.S. Pat. No. 4,731,962 also involves a complex linking process, and is unsightly insofar as the tensile cords (15) are outside of the rods. This invention does not appear to lend itself well to connecting rods end-to-end with tensile integrity, or to universally assembling polyhedral and other shapes and frames in general.

U.S. Pat. No. 4,404,240 uses various threads (6,8) in various configurations for interconnection, resulting in a complex, non-universal connection process, also without tensile integrity. The threading of these interconnections is also rather tedious and complicated. U.S. Pat. No. 4,614,502 uses strings (14) and pins (13) a manner also requiring complex and tedious threading to interconnect adjacent elements. Finally, U.S. Pat. No. 4,583,956 uses tendons (11) which are also strings threaded in a complex and tedious manner.

None of these references provides an optimal combination of universality, tensile integrity, modularity, and ease of assembly.

It is therefore desirable to provide modular elongated elements that can be connected with other similar modular elongated elements at any desired vertex angle, rather than at fixed, predetermined angles.

It is further desirable to provide modular elongated elements that can be connected with other similar modular elongated elements without limitation as to the number of such modular elongated elements that can be connected together at any given vertex.

It is further desirable to provide modular elongated elements that can be interconnected easily and quickly, without any tools.

It is further desirable to provide modular elongated elements that, once connected, provide inherent tensile integrity to the constructs they form.

It is further desirable to provide modular elongated elements that are universal, i.e., that provide suitable building blocks to construct virtually any construct such as a structure, assembly, frame, polyhedron, elongated composite (e.g. pole), or other elongated-element-based construct that is desired.

SUMMARY OF INVENTION

A modular elongated element, an intramodule tensile device, a pair of securing and linking devices, and an intermodule connector device, interconnected using the devices and methods disclosed herein, are used to construct a virtually limitless variety of inherently-tensile constructs. In the most elemental module, the intramodule tensile device connects a pair of securing and linking devices which are in turn secured to two ends of the modular elongated element.

BRIEF DESCRIPTION OF DRAWINGS

The novel features of the invention are set forth in the appended claims. The invention, however, together with further objects and advantages thereof, may best be understood by reference to the following description taken in conjunction with the accompanying drawing(s) in which:

FIG. 9 is a mixed perspective and schematic view illustrating an optional connecting and drawing facilitator added to the securing and linking devices of the earlier figures, which simplifies the method by which modular elongated elements are interconnected.

FIGS. 10 and 11 are schematic illustrations showing the desirability of providing modular elongated elements that are of varying lengths, including elements bearing certain desired length relationships relative to one another.

FIG. 12 illustrates in side plan view, a series of fixed angle joint connectors used to enforce a fixed angle at the joints between modular elongated elements, when a fixed rather than a flexible angle is desired.

FIG. 13 illustrates in side plan view, the passage of an intermodule connector device through the interior of an illustrative one of the fixed angle joint connectors of FIG. 12, prior to connecting adjacent modular elongated elements.

FIG. 14 illustrates in side plan view, a full connection between two modular elongated elements, using the fixed angle joint connector selected for the illustration of FIG. 13.

DETAILED DESCRIPTION

The term "constructs" will be used herein to designate broadly, anything which can be assembled using the systems, devices and methods disclosed herein, including, but not limited to: structures, assemblies, frames, polygons, polyhedra, elongated composites, or other elongated-element-based constructs, as well as combinations of all of these, constructed in accordance with this disclosure.

Figure 1:
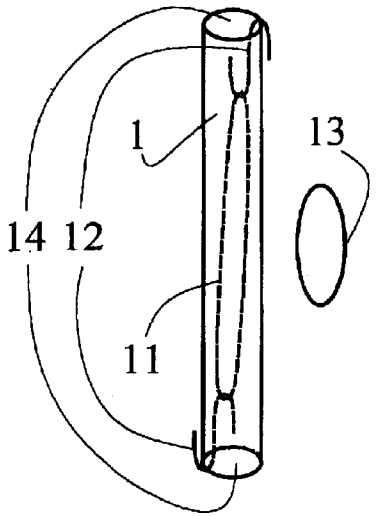
FIG. 1 is a perspective view illustrating the basic modular elongated elements of the invention and their "tensile skeletons," in a particular illustrative "toy model" embodiment.

FIG. 1 illustrates the basic elongated tensile module ("modular elongated apparatus") used to assemble a very wide range of such "constructs" in accordance with the invention herein disclosed. This basic elongated tensile module ("inherently-tensile, modular elongated apparatus," or "modular elongated apparatus" for brevity) comprises a modular elongated element 1, an intramodule tensile device 11, and a pair of securing and linking devices 12. (The use of the term "modular elongated element" is to be distinguished from the use of the term "modular elongated apparatus," particularly in the claims. Each modular elongated apparatus comprises a modular elongated element.) Also shown in FIG. 1 is a preferred, but optional, intermodule connector device 13. In the simplest embodiments of the invention, intramodule tensile devices 11 and intermodule connector devices 13 are identical elements simply used differently. In more complex embodiments, the intramodule tensile devices 11 and intermodule connector devices 13 may be different elements. The combination of an intramodule tensile device 11 connecting a pair of securing and linking devices 12 which are in turn secured to two ends 14 of the modular elongated element 1 as illustrated in FIG. 1 will henceforth be referred to as an "elementary tensile skeleton." Thus, in this parlance, FIG. 1 illustrates an inherently-tensile, modular elongated apparatus comprising modular elongated element 1 and an elementary tensile skeleton comprising intramodule tensile device 11 and a pair of securing and linking devices 12 connected to each end of intramodule tensile device 11 and further secured to each end of modular elongated element 1. FIG. 1 further illustrates a preferred but optional intermodule connector device 13 .

Modular elongated element 1 is a rod, tube, pole, pipe, strut or equivalent device, and the object is to form these modular elongated elements 1 into a wide range of constructs. Preferably, modular elongated element 1 is hollow through its interior in a way that makes it capable of containing intramodule tensile device 11, securing and linking devices 12, and intermodule connector devices 13 substantially within its interior. Note from FIG. 1 that modular elongated element 1 does not completely contain securing and linking devices 12, but only substantially contains them, since a small portion of securing and linking devices 12 is hooked over the ends 14 of modular elongated element 1. Broken lines are used throughout the drawings to illustrate drawing elements that are hidden from view in the particular perspective or other view illustrated.

Intramodule tensile device 11 is a tensile device such as a spring, elastic member, wench, reverse-jack, or equivalent device that provides a means for supplying tension between and drawing together whatever is attached to its ends. Securing and linking devices 12 are attached securely to the ends of intramodule tensile device 11, and also engage and secure to ends 14 of modular elongated element 1 such that they maintain intramodule tensile device 11 in a state of tensile expansion while modular elongated element 1 is disconnected from any other elements. Thus, securing and linking devices 12 are secured to the ends 14 of modular elongated element 1 with a degree of tension provided by intramodule tensile device 11. Intermodule connector devices 13 are used to connect together two or more securing and linking devices 12, and may or may not be tensile devices as described above.

In a "toy model" which will be used to illustrate the basic principals of the invention but which does not limit the applicability of the invention only to toys or to the elements used for this toy model illustration, modular elongated element 1 may be thought of as a hollow "straw," intramodule tensile device 11 may be thought of as a "elastic band," securing and linking devices 12 may be thought of as deformed "paper clips," and intermodule connector devices 13 may be thought of as "elastic bands" similar to those used for securing and linking devices 12. Thus, as can be seen in FIG. 1, the securing and linking devices 12, e.g., deformed paper clips, are hooked around (secured to) two ends of the intramodule tensile device 11, e.g., elastic band, and are also hooked around (secured to) the ends 14 of the modular elongated element 1, e.g., straw. As such, securing and linking devices 12 maintain intramodule tensile device 11 in an elongated tensile state, but, importantly, are also accessible from outside the ends 14 of the modular elongated element 1 such that they can be pulled away from these ends 14 in a manner that further stretches intramodule tensile device 11.

Figure 2:
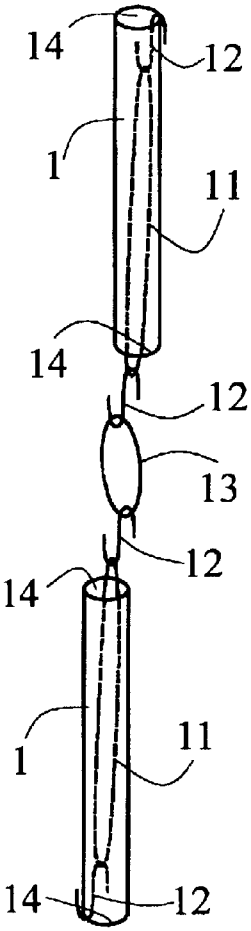
FIG. 2 is a perspective view illustrating the basic step of adjacently interconnecting two of the basic modular elongated elements of FIG. 1.

The purpose of this outside accessibility of securing and linking devices 12 becomes apparent in FIG. 2, which illustrates the basic step of adjacently interconnecting two of the modular elongated elements 1 of FIG. 1. When it is desired to interconnect two of the modular elongated elements 1, one of the securing and linking devices 12 from each of these modular elongated elements 1 is simply pulled (drawn) away from the ends 14 of its associated modular elongated element 1 and are connected to one another using intermodule connector device 13 as shown. The remaining securing and linking devices 12 remain secured to the non-connected ends 14 of their associated modular elongated element 1. Then, as illustrated in FIG. 3, the modular elongated elements 1 are drawn together such that the securing and linking devices 12 which are connected by intermodule connector device 13, as well as the intermodule connector device 13 itself, become contained within the hollow interiors of modular elongated elements 1.

Figure 3:
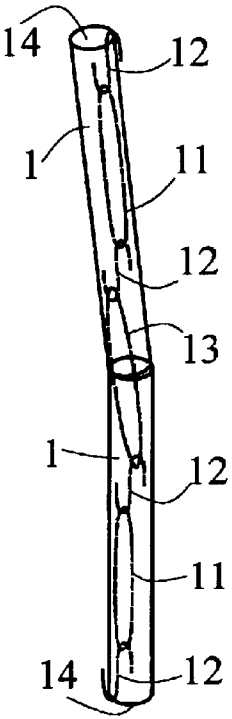
FIG. 3 is a perspective view illustrating these two adjacent modular elongated elements following their interconnection using the method of FIG. 2.

As can be seen in FIG. 3, this results in an elongate, inherently-tensile combination comprising, in series, from top to bottom, a first securing and linking device 12, a first intramodule tensile device 11, a second securing and linking device 12, the intermodule connector device 13, a third securing and linking device 12, a second intramodule tensile device 11, and a fourth securing and linking device 12. Because the first and fourth securing and linking devices 12 remain hooked around (secured to) the outer ends 14 of the modular elongated elements 1 in their original securing configuration, the aforementioned elongate, inherently-tensile combination serves to draw the two modular elongated elements 1 together with tensile integrity. This is the basic tensile integrity interconnection principle of the invention.

At this point, it can be seen why the "securing and linking" devices 12 are so-named. The first and fourth securing and linking devices 12 in FIG. 3, as well as the securing and linking devices 12 in FIG. 1, perform a "securing" function insofar as they are secured to the ends 14 of a modular elongated element 1 in a tensile manner, and in a manner that makes them accessible from outside. However, the second and third securing and linking devices 12 in FIG. 3 perform a "linking" function insofar as they are now connected via intermodule connector device 13 in a manner that forms part of an overall elongate, tensile combination providing tensile integrity to the construct being constructed. Thus, "securing" and "linking" are alternative required functions of securing and linking devices 12, depending upon the particular situation. While a deformed paper clip is thus a toy model example for securing and linking devices 12, what is crucial as regards the scope of this disclosure and its associated claims is that securing and linking devices 12 provide means for attaching to one end of an intramodule tensile device 11 and also securing under tension to one end of a modular elongated element 1 when utilized for "securing" functions (generally, when the elongated tensile module is "not connected" at the pertinent end from any entity such another elongated tensile module, an external anchoring point 1501 as in FIG. 15, etc.), and simultaneously provide means for remaining attached to the same one end of an intramodule tensile device 11 and also linking to an intermodule connector device 13 when utilized for "linking" functions (generally, when the elongated tensile module is "connected" at the pertinent end to an external entity such another elongated tensile module, an external anchoring point 1501 as in FIG. 15, etc.). Thus, securing and linking devices 12 as disclosed and claimed comprise any devices that provide and fulfill the securing and linking means and functions as described above. All manner of specially-configured wires, hooks, eyes, latches, and similar means for joining together two flexible members such as intramodule tensile devices 11 and intermodule connector devices 13 can be employed as the means to provide and fulfill these securing and linking means and functions.

Similarly, it can be seen that while intermodule connector device 13 may be identical to intramodule tensile devices 11, such as is illustrated here, this does not have to be the case. Thus, intermodule connector device 13 may comprise any types of bands (elastic or non-elastic), springs, chains, ropes, cables, ties, strings, cords, fabrics, ribbons, or other flexible connectors known in the art, fully within the scope of this disclosure and its associated claims. What is important here is that intermodule connector devices 13 provide a secure and flexible connection between two or more securing and linking devices 12 associated with two or more adjacent modular elongated elements 1. Whether intermodule connector devices 13 also add tensile pull between adjacent modular elongated elements 1, along with this and flexible connection, is optional depending on the situation. The essential tension required for tensile integrity is provided by the intramodule tensile devices 11, and any additional tension provided by intermodule connector devices 13 is supplemental and optional.

Starting from FIG. 3, to detach the modular elongated elements 1 from one another, modular elongated elements 1 are simply drawn apart until the second and third securing and linking devices 12 become again exposed as in FIG. 2. The intermodule connector device 13 is then removed. Finally, the second and third securing and linking devices 12 are resecured to the ends of their respective modular elongated elements 1, thereby reverting to their securing functions of FIG. 1, rather than their linking functions in the middle of FIG. 2.

As can be seen from FIG. 3, the link formed between modular elongated elements 1 is fully flexible, and is not in any way constrained to a particular angle, which is one important benefit of the invention. Thus, the modular elongated elements 1 of FIG. 3 can be bent about their common vertex at any desired angle from 0 to 180 degrees, in any plane. In the special situation where it is desired to connect modular elongated elements 1 end-to-end, or in some other predetermined, fixed manner, the ends of one or both modular elongated elements 1, in one embodiment, are simply modified so as to securely and fixedly mate with one another, using any of a broad range of devices and methods known in the art for such purpose.

Figure 4:
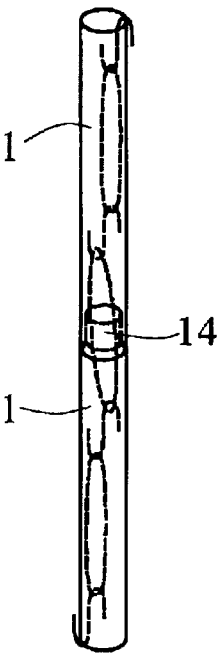
FIG. 4 is a perspective view illustrating the two adjacent modular elongated elements of FIG. 3 in the special case where these elements are mated together end to end to form a further-elongated construct.

Thus, for example, not limitation, FIG. 4 illustrates that one end of the lower modular elongated element 1 is narrowed 41 so as to securely mate with the upper modular elongated element 1, as shown. In combination with the tensile pull exerted by the earlier-mentioned elongate, tensile combination (tensile skeleton), this results in a secure, elongated tensile integrity construct. The end-to-end configuration of 4 can be used in any application where is desired to construct a long elongate construct, such as but not limited to a tent pole, out of a plurality of shorter elongate modules, with complete tensile integrity. The desired flexibility or rigidity of modular elongated elements 1 will vary for the application intended, depending upon whether some degree of bend is or is not desirable. Fixed angle joint connector 1201 later introduced in FIG. 12, provides an alternative illustrative example of how to construct a long elongate construct out of a plurality of shorter elongate modules.

While FIG. 4 thus illustrates a 180 degree fixed interconnection, it is also possible within the scope of this disclosure and its associated claims to modify the ends of modular elongated elements 1 to fixedly mate at any other predetermined angle between 0 and 180 degrees, including "special" predetermined angles such as 30, 45, and 60 degrees that are useful for a variety of fixed construction situations. In all cases, the tensile connections remain fully intact. FIGS. 12 through 14 provide an illustrative alternative to modifying the ends of modular elongated elements 1 to achieve a fixed angular connection, and instead use fixed angle joint connectors 120.

Figure 6:
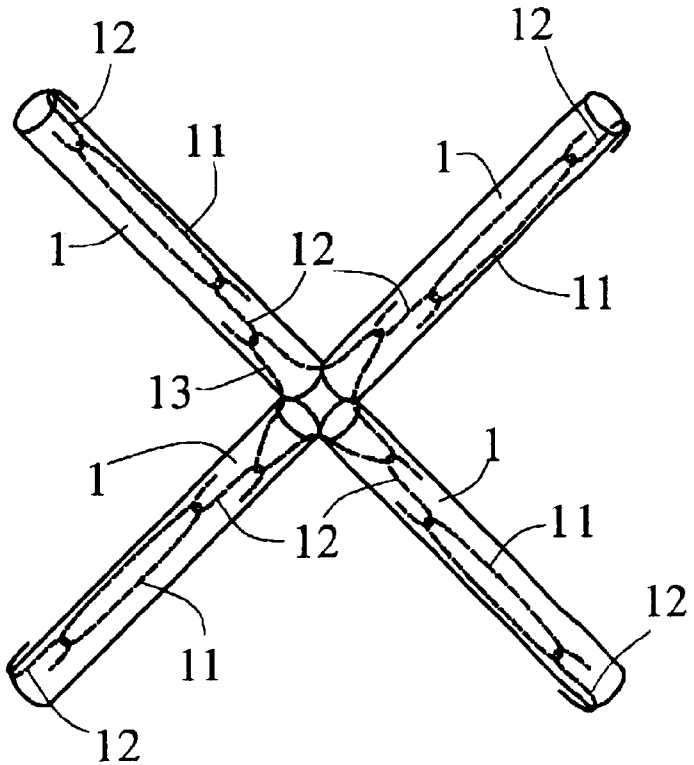
FIG. 6 is a perspective view illustrating the four elements of FIG. 5 following their interconnection using the method of FIG. 5.
Figure 5:
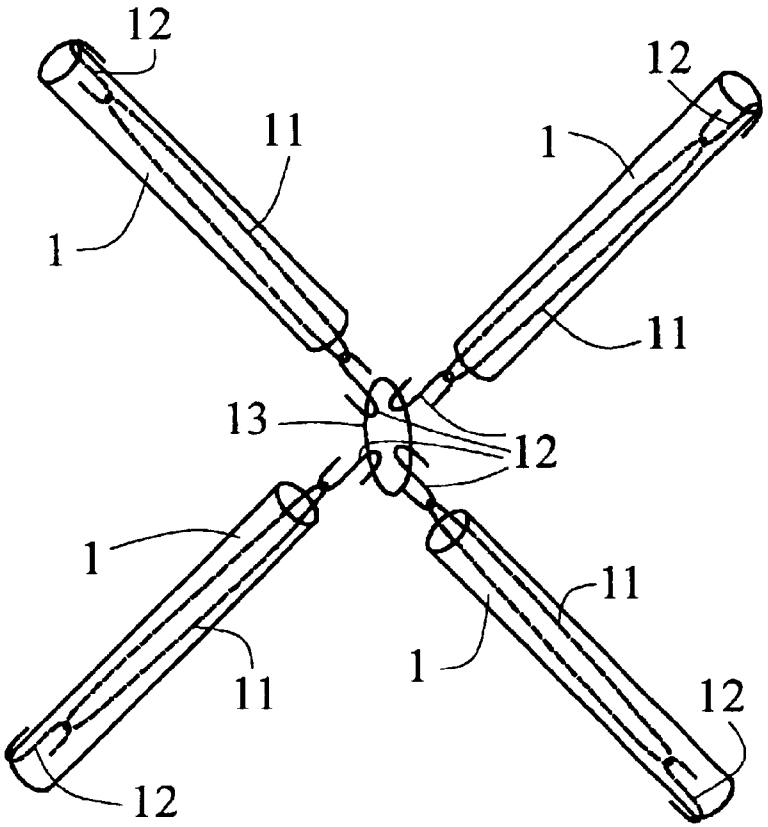
FIG. 5 is a perspective view illustrating the step of interconnecting three or more of the modular elongated elements of FIG. 1 at a single vertex, using four such elements so-interconnected as an illustrative example.

FIGS. 5 and 6 illustrates the interconnection of three or more modular elongated elements 1 at a single vertex, using four such elements so-interconnected as an illustrative example. Similarly to FIG. 2, when it is desired to interconnect two or more of the modular elongated elements 1 at a single vertex, one of the securing and linking devices 12 from each of these modular elongated elements 1 is simply pulled away from the end 14 of its associated modular elongated element 1. These are then all connected to one another, preferably using a single intermodule connector device 13 as shown in FIG. 5. The remaining securing and linking devices 12 remain secured to the non-connected ends 14 of their associated modular elongated elements 1. Although a single intermodule connector device 13 is preferred because it provides the greatest simplicity and minimizes the number of required elements to assemble a tensile integrity construct, this does not preclude using a plurality of intermodule connector devices 13 at any given vertex to connect a plurality of securing and linking devices 12 with one another, within the scope of this disclosure and its associated claims.

Then, as shown in FIG. 6, similarly to FIG. 3, the modular elongated elements 1 at a given vertex are drawn together such that their associated securing and linking devices 12 which are connected by intermodule connector devices 13, as well as the intermodule connector devices 13 themselves, become contained within the hollow interiors of modular elongated elements 1. The tensile integrity is provided by intramodule tensile devices 11, and optionally, by intermodule connector device 13 if intermodule connector device 13 is also a tensile device. Disassembly is again as earlier described, namely, modular elongated elements 1 are pulled back apart to their FIG. 5 configuration, intermodule connector device 13 is removed, and securing and linking devices 12 are returned to their securing configuration of FIG. 1, as opposed to their linking configuration.

FIGS. 5 and 6 illustrate further benefits of the invention. As is easily understood from these figures, any number of modular elongated elements 1 can be interconnected at a given vertex without restriction, in the same way as is illustrated here for four such modular elongated elements 1. Additionally, because intermodule connector device 13 is flexible, these modular elongated elements 1 can be interconnected with one another at any angles desired relative to one another, in the same plane to form a two-dimensional construct, or in different planes to form a three-dimensional construct. In short, the manner of forming each vertex is totally unrestricted. Finally, the entire network of interconnections established in FIG. 6 among the various intramodule tensile devices 11, securing and linking devices 12, and intermodule connector devices 13 forms a "tensile skeleton" running throughout, and completely mirroring the geometry of, the entire construct that is assembled from the modular elongated elements 1. This tensile skeleton is constructed as a natural byproduct of the inherent configuration of each module, as disclosed in FIG. 1, and the methods outlined in FIGS. 2 though 6 for interconnecting these modules. Thus, any construct constructed in this way is itself inherently tensile.

Figure 8:
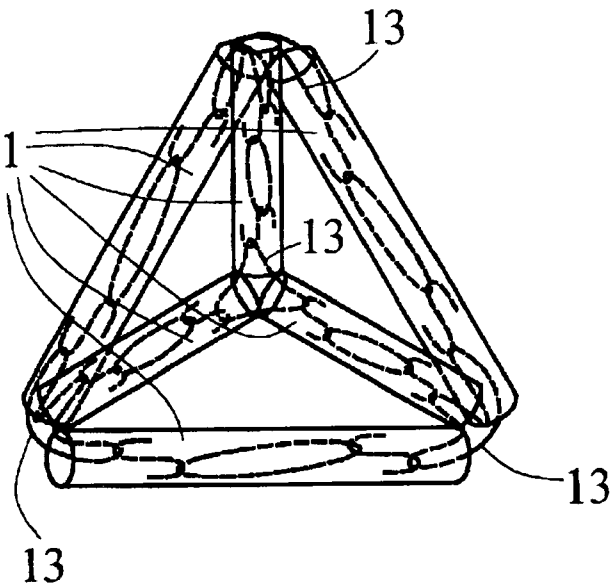
FIG. 8 is a perspective view illustrating the six elements of FIG. 7 following their interconnection into the tetrahedral construct.
Figure 7:
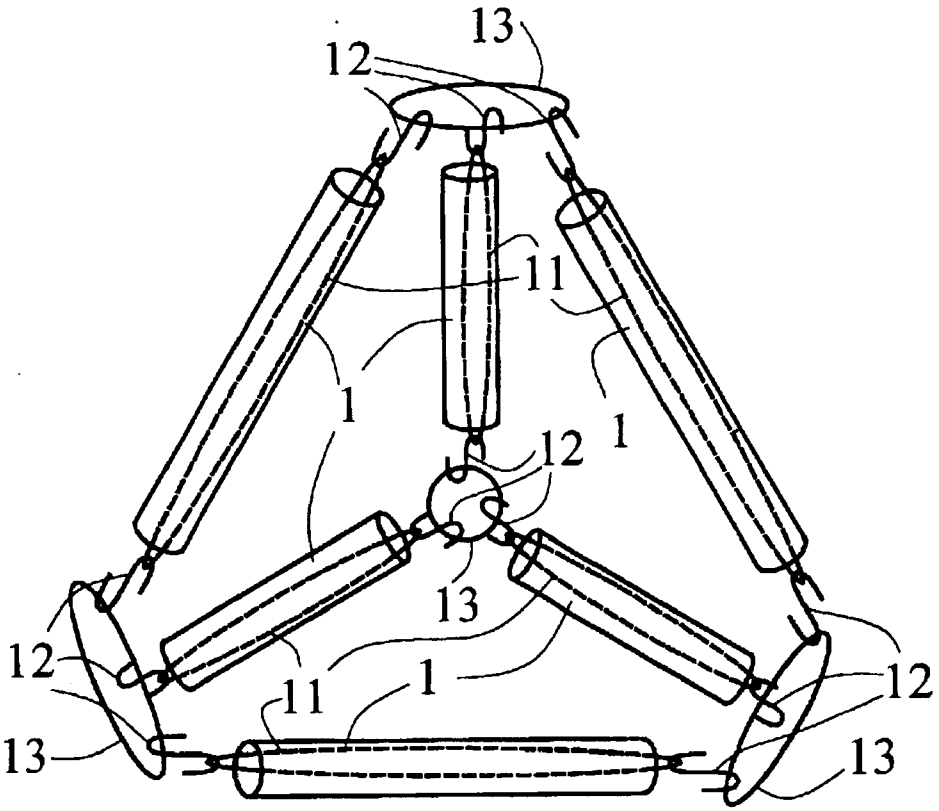
FIG. 7 is a perspective view illustrating the step of interconnecting several modular elongated elements of FIG. 1 into a construct without any endpoint, using six such elements so-interconnected into a tetrahedral polyhedron as an illustrative example.

FIGS. 7 and 8 illustrate interconnecting modular elongated elements 1 into a construct without any endpoint, using six interconnected modular elongated elements 1 constructed into a tetrahedral polyhedron as an illustrative example. FIG. 7, similarly to FIGS. 2 and 5, illustrates pulling all of the securing and linking devices 12 at a given vertex away from the ends of their associated modular elongated elements 1, connecting them using intermodule connector devices 13, and then drawing them together such that their associated securing and linking devices 12 as well as the intermodule connector devices 13 themselves become contained within the hollow interiors of modular elongated elements 1. The resulting configuration is the tetrahedron in FIG. 8. In this configuration, and indeed for any fully closed geometric construct with no "endpoint," all of the securing and linking devices 12 are used for linking, rather than securing. Disassembly proceeds from FIG. 8 to FIG. 7 similarly to what was earlier described for moving back from FIG. 6 to FIG. 5, and from FIG. 3 to FIG. 2.

The tetrahedral polyhedron of FIG. 8 is just an example, and it should be understood from the foregoing that modular elongated elements 1 in combination with their "elementary tensile skeletons" as illustrated in FIG. 1, are the fundamental building blocks used to construct any type of construct that one might wish to construct out of modular elongated elements 1 such as rods, tubes, poles, pipes, struts and the like. There is no inherent limitation as to the angles in all three dimensions that may be achieved between modular elongated elements 1 converging at a single vertex, or as to how many modular elongated elements 1 may be converged at a single vertex. As such, a modular elongated element 1, in combination with its "elementary tensile skeleton," is a universal building block for any desired construct whatsoever, including, but not limited to: structures, assemblies, frames, polygons, polyhedra, elongated composites, or other elongated-element-based constructs, as well as combinations of all of these. This includes constructs in which elongated elements involving two or more modular elongated elements 1 form an edge or other cross-connector of the construct. Geodesic spheroids are among the many variety of constructs that are readily constructed from these modular elements.

Very importantly, any construct that is constructed from modular elongated elements 1 in combination with their elementary tensile skeletons, according to the methods herein described, will possess inherent tensile integrity, which is a direct and inherent by-product of the inherently-tensile properties of modular elongated element 1 in combination with its elementary tensile skeleton of FIG. 1. Thus, modular elongated elements 1 in combination with their elementary tensile skeletons, are not only universal building blocks for any and all constructs constructed out of elongated elements, but they are inherently-tensile building blocks which will cause any such construct to also be inherently-tensile.

At this point, having explained the basic principles of the invention, we now turn to examine a number of variations, enhancements, and alternative embodiments and applications.

It was observed in FIG. 2 (as well as FIGS. 5 and 7) that the securing and linking devices 12 from each modular elongated element 1 to be connected at a given vertex are simply pulled (drawn) away from the ends 14 of their associated modular elongated elements 1 and connected to one another using an intermodule connector device 13. In practice, the drawing of these securing and linking devices 12 away from each modular elongated element 1 may be somewhat difficult depending upon the manual dexterity of the person performing the interconnection, the tensile strength of intramodule tensile devices 11 involved, and similar factors. This process of drawing securing and linking devices 12 away modular elongated elements 1 can be facilitated if securing and linking devices 12 further comprise an optional connecting and drawing facilitator 61 such as, but not limited to, the reverse-hooked section illustrated in FIG. 9, which is utilized in the "toy model."

Thus, prior to arriving at the configuration shown in FIG. 2 (or FIG. 5 or 7 or similar configurations), intermodule connector devices 13 are pre-connected to the appropriate securing and linking devices 12, with the aid of optional connecting and drawing facilitators 61, while these securing and linking devices 12 are still secured to the ends 14 of their respective modular elongated elements 1, and before their respective modular elongated elements 1 are drawn apart. Thus, starting from FIG. 9, modular elongated elements 1 are then drawn apart, and this drawing apart will naturally serve to also draw securing and linking devices 12 away from their modular elongated elements 1, into the configuration of FIG. 2, due to this pre-connection of intermodule connector devices 13 to securing and linking devices 12. In short, intermodule connector devices 13 are used not only to connect modular elongated elements 1 to one another in the final construct, but also to draw securing and linking devices 12 out away from their respective modular elongated elements 1 during the process of constructing the final construct. At this point, it becomes very simple to then draw modular elongated elements 1 back together in such a way that intermodule connector devices 13 and securing and linking devices 12 end up in the interior of modular elongated elements 1 as shown in FIG. 3 (as well as FIGS. 4, 6 and 8, and in similar configurations), thus creating the tensile skeleton of the construct being constructed. Note, it is understood that in industrial situations, where human strength is insufficient to draw modular elongated elements 1 apart due to the high tensile forces that may be involved, various machines 91 may also be used to provide the required power to affect the operations illustrated in going from configurations such as FIG. 9, to FIG. 2, then to FIG. 3, and also back again.

It is of course understood that modular elongated elements 1 and their tensile skeletons can be provided in any length and size whatsoever. It is also understood that by following the disclosure of FIG. 4, (or FIG. 12 for fixed angle joint connector 1201 ), these modular elongated elements 1 and their elementary tensile skeletons can be assembled into longer elongated tensile constructs (elongated tensile composites) with lengths equivalent to the sum of the lengths of their individual modular elongated elements 1. If all the modular elongated elements 1 used to construct this elongated tensile composite are of equal lengths, then the length of this elongated tensile composite will be some multiple of the length of the basic modular elongated element 1.

Of course, it may be desired to provide modular elongated elements 1 of varying relative length, depending on the particular constructs that it is desired to construct, and the particular applications to which these constructs will be put. For example, if the basic modular elongated elements 1 in a particular application are of length x, and it is desired to construct square constructs with 90 degree vertices, it might be desirable to provide modular elongated elements 1 with lengths that are $\sqrt{2} \cdot x$ so as to provide suitable diagonals for structural support, as illustrated in FIG. 10. To provide diagonal supports for triangular, hexagonal, or similar constructs, it might be desirable to provide modular elongated elements i with lengths that are $\sqrt{3} \cdot x$, as illustrated in FIG. 11. Similar diagonal support elements which are square root multiples of x, (e.g., $\sqrt{n} \cdot x$, where n is any integer greater than 1), or which involve x multiplied or divided by a transcendental number such as $\pi$ or e, may also be useful in a particular situation. Of course, the discussion or illustration of certain types of root-based or transcendental-based relative length relationships among the modular elongated elements 1 is for example only, and it is considered to be within the scope of this disclosure and its associated claims to provide these modular elongated elements 1 at any and all lengths without restriction, as well as in any desired lengths ratios relative to one another without restriction.

While the system, apparatus and method disclosed thus far is a flexible joint system which allows modular elongated elements 1 at any vertex to be interconnected with one another in any number and at any desired angle, there may be applications, such as in building or other construction where loads are to be borne and strength is thus required, where the constructs created according to this invention need ultimately to provide a fixed angle at one or more joints. Thus, it is also desirable for situations where a fixed angle is desired, to provide a suitable set of rigid joint connectors that impose a fixed angle between two or more modular elongated elements 1 sharing a common vertex.

FIGS. 12 through 14 illustrate one of many possible embodiments through which the flexible joint angles inherent in the construction methods outlined in FIGS. 1 through 9 can be made fixed in situations where this is desirable. FIG. 12 illustrates fixed angle joint connectors 120 used to enforce a substantially fixed angle at the joints between modular elongated elements 1. Fixed angle joint connectors 120, comprising illustrative elements 1201, 1202, 1203, 1204, 1205 and 1206, respectively provide fixed bends of 0, 30, 45, 60, 90, and 120 degrees between two modular elongated elements 1 that they are used to fixedly connect at a single vertex. Other angles can of course be provided just as well within the scope of this disclosure and its associated claims. The angles shown here are selected simply because they are commonly used in many construction settings. In the illustrated embodiment, these fixed angle joint connectors 120 have widths that are slightly narrower than the widths of modular elongated elements 1 so that they will fit snugly inside the ends of modular elongated elements 1. The exception is the 0 degree joint 1201, which has a slightly-protruding midsection of substantially the same width as modular elements 1, for reasons to be discussed shortly. This 0 degree joint 1201 provides alternative means to enforce a rigid end-to-end connection such as is illustrated in FIG. 2. These fixed angle joint connectors 120 and similar fixed angle joint connectors for other angles, like the modular elongated elements 1, comprise a hollow interior that allows part of the tensile skeleton to pass therethrough.

To use these fixed angle joint connectors 120 and similar connectors for other angles from 0 to 180 degrees, one must first pass an intermodule connector device through the interior of a fixed angle joint connector 120, such as is illustrated in FIG. 13 for the 90 degree connector 1205. Then, intermodule connector device 13, already passing through and surrounded by the fixed angle joint connector, is connected to the securing and linking devices 12 of the adjacent modular elongated elements 1, similarly to what was shown in FIG. 9. At that point, the process of connecting adjacent modular elongated elements 1 proceeds just as earlier described in connection with FIGS. 2 and 3, 5 and 6, and 7 and 8. The only difference is that once the tensile skeleton is established, the ends of modular elongated elements 1 are drawn together so as to insert around (or, into in an alternative embodiment where the fixed angle connectors are slightly wider than modular elongated elements 1 ) the fixed angle joint connectors 120, resulting in a configuration such as is shown in FIG. 14. It will be observed that in FIG. 14, modular elongated elements 1 are drawn together by the tensile skeleton with complete tensile integrity, and the joint angle is made fixed by the fixed angle joint connector 120 in this illustration, 90 degree connector 1205.

For all fixed angle joint connectors 120 other than the end-to-end connector 1201, the joint angle itself acts as a "stop," thereby preventing the fixed angle joint connector 120 from sliding too far into the modular elongated elements 1. For end-to-end connector 1201, there is no such angle to act as a "stop," and so the earlier-mentioned slightly-protruding midsection of end-to-end connector 1201 is used as an illustrative example of a stop to prevent end-to-end connector 1201 from sliding too far into the modular elongated elements 1.

It is to be observed that for many applications, due to the inherent tensile integrity of all constructs constructed from modular elongated elements 1 and their elementary tensile skeletons, there is no need to provide a permanent attachment between modular elongated elements 1 and any fixed angle joint connectors 120. This is because the inherent tensile properties of these constructs will hold them together without anything else. That is, the inherent-tensile properties hold the modular elongated elements 1 together, and the fixed angle joint connectors 120 fixedly maintain the desired angle. However, FIG. 14 also illustrates optional attachment means 1401 such as, but not limited to, screws, nails, bolts, pins, welds, solders, rivets, adhesives, etc., and any other means known in the art for attaching together elements such as modular elongated elements 1 with elements such as the fixed angle joint connectors 120. For example, there may be certain construction situations where durable, permanent angle joints are desired between modular elongated elements 1, and where the tensile skeleton serves to "loosely" hold together the construct or a suitable portion thereof on a temporary basis during its assembly. Once the entire construct or a suitable portion thereof is completed, the final step in establishing a permanent, durable construct is to use attachment means 1401 to permanently and durably attach together the modular elongated elements 1 at their fixed joints. In short, in this situation, the tensile integrity is used to provide a temporary tie among all elements, prior to permanently fixing them together once a proper configuration is achieved.

Finally, although FIG. 12 illustrates two-element fixed angle joint connectors 120, it is understood that n-element fixed angle joint connectors 120 can be provided for any situation where it is desired to fixedly connect together a total of n modular elongated elements 1 at a given vertex, where n is any integer greater than 1. Thus, for example, a fixed angle joint connector 120 for the corners of a cube will connect 3 elements at 90 degrees from one another, in a mutually-orthogonal configuration. For another example, a fixed angle joint connector 120 for the vertices of a geodesic dome will typically connect 6 elements at roughly 60 degrees from one another, in an almost-coplanar manner, with a slight bend from the common plane to provide curvature to the overall dome.

Figure 15:
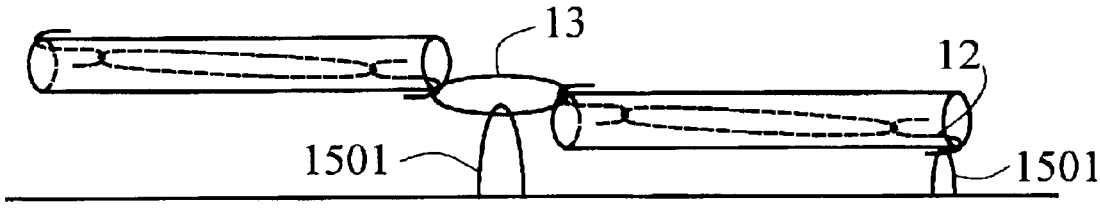
FIG. 15 illustrates in a mixed perspective and schematic view, the anchoring to external anchoring points, of constructs constructed from the modular elongated elements of FIG. 1.

In certain situations, it may be desirable to connect one or more modular elongated elements 1 or the constructs built therefrom to external anchoring points. This can be done using the securing and linking devices 12 and intermodule connector devices 13 disclosed throughout. Thus, for example, FIG. 15 illustrates the anchoring to external anchoring points 1501, of constructs constructed from the modular elongated elements of FIG. 1. Toward the right of FIG. 15, an endpoint securing and linking device 12 that is used in its securing function is also anchored to an external anchoring point 1501 as shown. Toward the center of FIG. 15, an intermodule connector device 13 is similarly anchored to an external anchoring point 1501 as shown. Extension of the anchoring principles schematically illustrated in FIG. 15 to all types of complex constructs is straightforward.

In some situations, it may be desired to slightly adjust the length of one or more modular elongated elements 1 to produce a better or tighter fit among all the components of a given construct, even after they are part of that construct.

Figure 16:
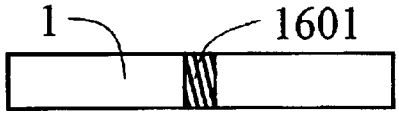
FIG. 16 illustrates in side plan view, an adjustable-length modular elongated element.

Thus, FIG. 16 illustrates an adjustable-length modular elongated element 1 comprising a length adjustment device 1601 providing means for adjusting (increasing or decreasing) the length of modular elongated element 1. In this illustration, length expansion and contraction is achieved simply by means of a conventional screwing apart or together of two different sub-segments of modular elongated element 1. Other length adjustment devices providing means known to those of ordinary skill for adjusting the length of elongated elements such as rods, tubes, poles, pipes, struts and the like, when used in combination with modular elongated elements 1 and their elementary tensile skeletons, are considered to also be within the scope of this disclosure and its associated claims.

In the discussion thus far, the intramodule tensile devices 11 have been inherently tensile, i.e., they were considered to comprise elastic bands, springs, and similar devices which inherently draw together objects at their two ends. In some situations, however, intramodule tensile devices 11 may not be inherently tensile, but may derive their tension by the application of mechanical principles such as winding, reverse-jacking, wenching, etc., that serve to draw their ends together. Such a situation is shown in FIG. 11, which schematically illustrates the use of a tightening and loosening device 1101 for mechanically adding tension to or relaxing tension from an intramodule tensile device 11 of a modular elongated element 1. However, this is now done via mechanical means known to those of ordinary skill in the art, rather than via inherent tensile properties of the intramodule tensile device 11. It is presumed that in many instances, such tightening and loosening devices 1101 will require that a small aperture be made in the side of modular elongated element 1 so that tightening and loosening device 1101 can mechanically operate directly upon intramodule tensile device 11. Alternatively, a remote control device 1102 can be used to control the mechanical increasing or relaxation of the tension in intramodule tensile devices 11, without the need for any such aperture. In this instance, the application of a single signal can be used to tighten or loosen the tensile connections of an entire structure at will.

Figure 17:
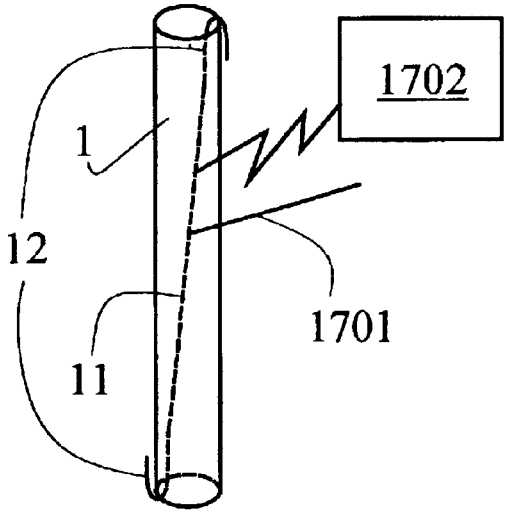
FIG. 17 illustrates in mixed perspective and schematic view, the use of a tightening device for mechanically adding tension to the intramodule tensile device of a modular elongated element.

An additional range of inherently-tensile constructs can be constructed from the modular elongated apparatus of FIG. 1 when pairs of these modular elongated apparatuses are flexibly connected together at a point between their ends, as shown in FIG. 11. This flexible connection 1801 is characterized in that the two modular elongated apparatuses are secured reasonably well to each other to avert undesired slippage at the connection (but possibly to permit slippage when desired), and also to allow angular rotation of one modular elongated apparatus relative the other over a range of up to 180 degrees, that is, to allow the angle 1802 to range substantially anywhere from 0 to 180 degrees. In FIG. 17, flexible connection 1801 is illustrated proximate the midpoints of these modular elongated apparatuses, but it is understood that flexible connection 1801 may also be at somewhere other than these midpoints (i.e., at any intermediate point of these modular elongated apparatuses) within the scope of this disclosure and its associated claims.

Figure 19:
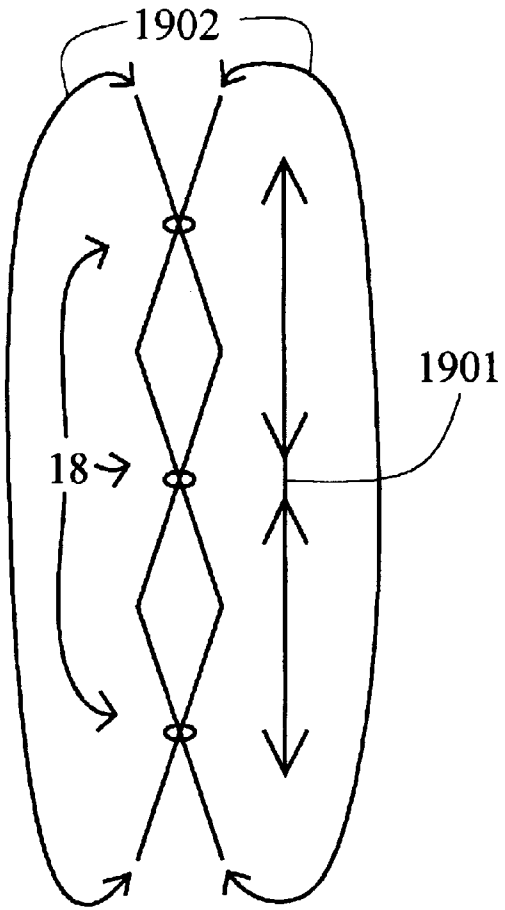
FIG. 19 is a schematic illustration showing three of the flexibly-connected modular elongated element pairs of FIG. 18 serially connected end-to-end with one another.
Figure 18:
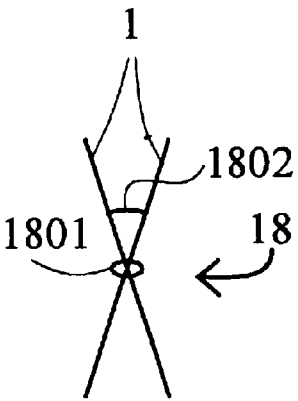
FIG. 18 is a schematic illustration showing a pair of modular elongated elements flexibly connected at a point between their ends (in this illustration, at their midpoints).

The flexibly-connected modular elongated apparatus pair 18 of FIG. 18 may then be connected end-to-end with like flexibly-connected modular elongated apparatus pairs 18 as shown in FIG. 19, in an inherently-tensile manner, using the devices and methods heretofore described in great detail for connecting any given modular elongated apparatus end-to-end with an adjacent modular elongated apparatus. Because of flexible connection 1801, the construct of FIG. 19, and constructs similar to that of FIG. 19, can expand and contract in a "accordion-like" manner, together and apart along the line 1901.

Figure 20:
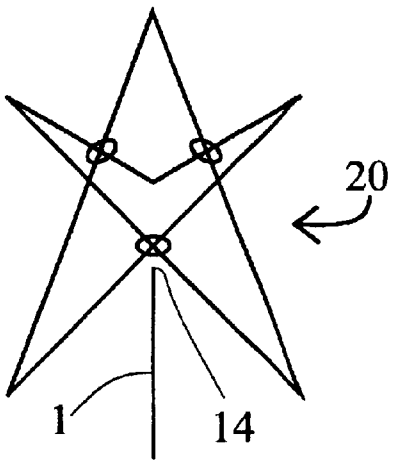
FIG. 20 is a schematic perspective illustration showing a structure that results when the open endpoints of the FIG. 19 configuration connected together. -

Then, when the open ends of the construct of FIG. 19 are joined together along the lines 1902 also using the devices and methods heretofore described in great detail for connecting any given modular elongated apparatus end-to-end with an adjacent modular elongated apparatus, the resulting structure is that of FIG. 20, which in this case, is similar in 3-dimesional appearance to the frame of the old-fashioned "sling chairs." Similar structures of interest can be constructed by the creative interconnection of a plurality of flexibly-connected modular elongated apparatus pairs 18.

Additionally, an end 14 of one or more modular elongated elements 1 can be interconnected with one or more of the intermediate flexible connections 1801 as shown in FIG. 20, resulting in a hybrid connection involving both endpoints and intermediate points of modular elongated apparatuses.

Although the illustrations herein depict a circular or elliptical cross-sectional profile for modular elongated element 1, it is to be understood that any cross section suitable to the particular application to which this invention is applied is considered to be within the scope of this disclosure and its associated claims. It is also noted that depending on the nature of the securing and linking devices 12, that intermodule connector devices 13 can actually be omitted in some instances, and that securing and linking devices 12 of adjacent modular elongated elements 1 can be connected directly to one another. Thus, intermodule connector devices 13 are preferred, but not essential, elements of the invention. Thus, for example, the securing and linking devices 12 in FIGS. 2 and 3 (and other similar figures) that are connected by intermodule connector devices 13 can instead be connected directly to one another. The limitation here is that securing and linking devices 12 may end up residing at the joint line between adjacent modular elongated elements 1, and to the extent that securing and linking devices 12 are not flexible, the flexibility of the joint angle may therefor be limited to more obtuse, and less acute angles. If one adjusts the relative lengths of the intramodule tensile devices 11 as among modular elongated elements 1 so as to ensure that securing and linking devices 12 do not end up residing at the joint line between adjacent modular elongated elements 1, then intermodule connector devices 13 can be fully omitted without adversely affecting the joint angle flexibility. Similarly, to the extent that securing and linking devices 12 can be provided with suitable flexibility, intermodule connector devices 13 can also be omitted.

It is understood that modular elongated elements 1 and their elementary tensile skeletons can be used in a wide variety of applications using the connection devices and methods disclosed herein. For example, not limitation, these can be used for: various construction toys; various educational models such as for mathematics and chemistry; various mobiles and other stick-figure toys; various situations in which it is desired to construct and later deconstruct an elongated pipe or pole from smaller modular elements (e.g., for tent assembly); fluid-carrying and wire-carrying conduit networks, to the degree that the tensile skeleton does not impede the flow of any substances being transported through these conduit networks (for wires, if the tensile skeleton is suitably conductive, this skeleton can even double as the power or signal carrier); various permanent construction or assembly situations where it is desired to construct permanent constructs comprising elongated elements in whole or in part; various temporary construction situations where it is desired to construct temporary constructs comprising elongated elements in whole or in part which can later be deconstructed or disassembled; and framing in general, wherein it is desired to use elongated members to produce a frame of any sort to which other elements may subsequently be added.

It is to be understood that this disclosure and its associated claims apply to: the modular elongated elements 1 and their elementary tensile skeletons per se and to the methods inherent therein; the various devices and methods disclosed for assembling modular elongated elements 1 and their elementary tensile skeletons into composite, inherently-tensile constructs; any and all composite, inherently-tensile constructs that comprise the modular elongated elements 1 and their elementary tensile skeletons; and any and all composite, inherently-tensile construct products created by the processes herein disclosed.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. An inherently-tensile construct comprising at least one inherently-tensile, modular elongated apparatus, each said at least one modular elongated apparatus comprising an elementary tensile skeleton, said elementary tensile skeleton consisting of:

intramodule tensile means (11) for providing tensile pull;

a modular elongated element (1);

first securing and linking means (12) for the three combined functions of securing a first end of said intramodule tensile means (11) to a first end (14) of said modular elongated element (1), maintaining said intramodule tensile means (11) in an accessible state for when it is desired to link said first end of said intramodule tensile means (11) with a first external entity, and linking said first end of said intramodule tensile means (11) with said first external entity;

second securing and linking means (12) for the three combined functions of securing a second end of said intramodule tensile means (11) to a second end (14) of said modular elongated element (1), maintaining said intramodule tensile means (11) in an accessible state for when it is desired to link said second and of said intramodule tensile means (11) with a second external entity, and linking said second end of said intramodule tensile means (11) with said second external entity; and an intramodule tensile connection between said first securing and linking means (12) and said second securing and linking means (12) via said intramodule tensile means (11), thereby drawing said first securing and linking means (12) and said second securing and linking means (12) toward one another, under said tensile pull; wherein:

when said modular elongated element (1) is not connected proximate its said first and second ends (14) with said first and second external entities, said intramodule tensile means (11) runs lengthwise, and connects said first securing and linking means (12) and said second securing and linking means (12), through an interior of said modular elongated element (1);

when said modular elongated element (1) is not connected proximate its said first end (14) with said first external entity, said first end of said intramodule tensile means (11) is secured via said first securing and linking means (12) to said first end (14) of said modular elongated element (1), and, simultaneously, said first securing and linking means (12) is secured to said first end of said modular elongated element (1), all under and by virtue of said tensile pull; and when said modular elongated element (1) is not connected proximate its said second end (14) with said second external entity, said second end of said intramodule tensile means (11) is secured via said second securing and linking means (12) to said second end (14) of said modular elongated element (1), and, simultaneously, said second securing and linking means (12) is secured to said second end of said modular elongated element (1), all under and by virtue of said tensile pull.

2. The inherently-tensile construct of claim 1, said at least one modular elongated apparatus comprising exactly one modular elongated apparatus.

3. The inherently-tensile construct of claim 1, wherein further:

when the said modular elongated element (1) of at least one of said modular elongated apparatuses is connected proximate its said first end (14) with said first external entity, the first end of its said intramodule tensile means (11) is linked via its said first securing and linking means (12) with said first external entity, under said tensile pull; and when the said modular elongated element (1) of at least one of said modular elongated apparatuses is connected proximate its said second end (14) with said second external entity, the second end of its said intramodule tensile means (11) is linked via its said second securing and linking means (12) with said second external entity, under said tensile pull.

4. The inherently-tensile construct of claim 3, said at least one modular elongated apparatus comprising exactly one modular elongated apparatus.

5. The inherently-tensile construct of claim 3, wherein:

said modular elongated element (1) of at least one of said modular elongated apparatuses is connected proximate at least one of its said ends (14) with the external entities by being connected with anchoring means (1501) for anchoring said modular elongated apparatus.

6. The inherently-tensile construct of claim 5, wherein:

said modular elongated element (1) of said at least one of said modular elongated apparatuses is connected with said anchoring means (1501) by connecting together at least one of its said securing and linking means (12) and its second securing and linking means (12) with said anchoring means (1501).

7. The inherently-tensile construct of claim 3, said at least one modular elongated apparatus comprising a plurality of said modular elongated apparatuses, wherein:

the modular elongated element (1) of a first one of said modular elongated apparatuses is connected proximate at least one of its said ends (14) with at least one said external entity by being connected with at least one other of said modular elongated.

8. The inherently-tensile construct of claim 7, wherein:

said modular elongated element (1) of said first one of said modular elongated apparatuses is connected proximate both of its said ends (14) with at least one said external entity by being connected proximate both of its said ends (14) with at least one other of said modular elongated apparatuses.

9. The inherently-tensile construct of claim 7, wherein a length of at least one of said modular elongated apparatuses differs from a length of at least one other of said modular elongated apparatuses.

10. The inherently-tensile construct of claim 9, wherein the length of said at least one of said modular elongated apparatuses differs from the length of said at least one other of said modular elongated apparatuses by a factor of √n, where n is any integer greater than 1.

11. The inherently-tensile construct of claim 7, wherein:

said modular elongated element (1) of the first modular elongated apparatus is connected proximate said at least one of its said ends (14) with a plurality of other said modular elongated apparatuses.

12. The inherently-tensile construct of claim 7, wherein:

said modular elongated element (1) of said first one of said modular elongated apparatuses is connected with said at least one other said modular elongated apparatus by connecting together at least one of its first securing and linking means (12) and its second securing and linking means (12) with at least one securing and linking means (12) of said at least one other of said modular elongated apparatuses.

13. The inherently-tensile construct of claim 12, further comprising:

intermodule connector means (13) for connecting the first modular elongated apparatus with the at least one other modular elongated apparatus, said intermodule connector means (13) connecting the securing and linking means (12) of the first modular elongated apparatus with said securing and linking means (12) of said at least one other of said modular elongated.

14. The inherently-tensile construct of claim 7, further comprising:

at least one fixed angle joint connection means (120) for substantially fixing angles among at least two adjacent modular elongated elements (1), wherein:

said at least one fixed angle joint connection means (120) is connected between said modular elongated element (1) of said first one of said modular elongated apparatuses and said at least one other of said modular elongated apparatuses, thereby substantially fixing an angle thereamong.

15. The inherently-tensile construct of claim 7, wherein:

at least one pair of said modular elongated apparatuses are flexibly connected together (1801) proximate a point between the said first ends (14) and second ends (14) thereof.

16. The inherently-tensile construct of claim 15, wherein:

an end (14) of a least one of said modular elongated apparatuses is connected proximate the flexible connection (1801).

17. The inherently-tensile construct of claim 1, the modular elongated element (1) of at least one of said modular elongated apparatuses further comprising containment means for containing, and containing, said first securing and linking means (12), said second securing and linking means (12), and said intramodule tensile means (11), substantially within said interior of said modular elongated element (1).

18. The inherently-tensile construct of claim 1, the securing and linking means (12) of at least one of said modular elongated apparatuses further comprising:

connecting and drawing facilitation means (61) for drawing said securing and linking means (12) away from its said modular elongated element (1) to facilitate linking its intramodule tensile means (11) with said external entities.

19. The inherently-tensile construct of claim 1, the modular elongated element (1) of at least one of said modular elongated apparatuses further comprising:

length adjustment means for adjusting a length of said modular elongated element (1).

20. The inherently-tensile construct of claim 1, wherein:

said intramodule tensile means (11) of at least one of said modular elongated apparatuses comprises an inherently-tensile device providing said tensile pull.

21. The inherently-tensile construct of claim 1, wherein:

said tensile pull of at least one of said modular elongated apparatuses is provided by mechanically drawing together the ends of said intramodule tensile means (11).

22. The inherently-tensile construct of claim 21, further comprising:

remote control means for remotely controlling said intramodule tensile means (11), causing said intramodule tensile means (11) to mechanically draw together said ends of said intramodule tensile means (11).

23. The inherently-tensile construct of claim 1, said at least one modular elongated apparatus comprising a plurality of said modular elongated apparatuses, wherein:

at least one pair of said modular elongated apparatuses are flexibly connected together (1801) proximate a point between the said first ends (14) and second ends (14) thereof.

24. The inherently-tensile construct of claim 23, wherein:

for at least one of said modular elongated apparatuses flexibly connected together (1801), said point between the first end (14) and second end (14) thereof comprises substantially a midpoint.

25. A method of making inherently tensile, a construct comprising at least one inherently-tensile, modular elongated apparatus, comprising the step of establishing an elementary tensile skeleton for each said at least one modular elongated apparatus, said step of establishing said elementary tensile skeleton consisting of the steps of:

providing tensile pull using intramodule tensile means (11) for providing tensile pull;

running said intramodule tensile means (11) lengthwise through an interior of said modular elongated element (1);

intramodularly connecting via said intramodule tensile means (11), and thereby drawing toward one another, through said interior of said modular elongated element (1), under said tensile pull:

first securing and linking means (12) for the three combined functions of securing a first end of said intramodule tensile means (11) to a first end (14) of a modular elongated element (1), maintaining said intramodule tensile means (11) in an accessible state for when it is desired to link said first end of said intramodule tensile means (11) with a first external entity, and linking said first end of said intramodule tensile means (11) with said first external entity; and second securing and linking means (12) for the three combined functions of securing a second end of said intramodule tensile means (11) to a second end (14) of said modular elongated element (1), maintaining said intramodule tensile means (11) in an accessible state for when it is desired to link said second end of said intramodule tensile means (11) with a second external entity, and linking said second end of said intramodule tensile means (11) with a second external entity;

not-connecting said modular elongated element (1) proximate its said first end (14) with said first external entity, by securing said first end of said intramodule tensile means (11) via said first securing and linking means (12) with said first end (14) of said modular elongated element (1), and, simultaneously, securing said first securing and linking means (12) to said first end of said modular elongated element (1), all under and by virtue of said tensile pull; and not-connecting said modular elongated element (1) proximate its said second end (14) with said second external entity, by securing said second end of said intramodule tensile means (11) via said second securing and linking means (12) with said second end (14) of said modular elongated element (1), and, simultaneously, securing said second securing and linking means (12) to said second end of modular elongated element (1), all under and by virtue of said tensile pull.

26. The method of claim 25, said at least one modular elongated apparatus comprising exactly one modular elongated apparatus.

27. The method of claim 25, further comprising the steps of:

connecting the said modular elongated element (1) of at least one of said modular elongated apparatuses proximate its said first end (14) with said first external entity, by linking the first end of its said intramodule tensile means (11) via its said first securing and linking means (12) with said first external entity, under said tensile pull; and connecting the said modular elongated element (1) of at least one of said modular elongated apparatuses proximate its said second end (14) with said second external entity, by linking the second end of its said intramodule tensile means (11) via its said second securing and linking means (12) with said second external entity, under said tensile pull.

28. The method of claim 27, said at least one modular elongated apparatus comprising exactly one modular elongated apparatus.

29. The method of claim 27, the steps of connecting the modular elongated element (1) of at least one of said modular elongated apparatuses with the external entities further comprising the step of:

connecting said modular elongated element (1) of at least one of said modular elongated apparatuses proximate at least one of its said ends (14) with anchoring means (1501) for anchoring said modular elongated apparatus.

30. The method of claims 29, the step of connecting said modular elongated element (1) of said at least one of said modular elongated apparatuses with said anchoring means (1501) further comprising:

connecting together at least one of the first securing and linking means (12) and said second securing and linking means (12) of said modular elongated element (l)with said anchoring means (1501).

31. The method of claim 27, said at least one modular elongated apparatus comprising a plurality of said modular elongated apparatuses, the steps of connecting said modular elongated element (1) of at least one of said modular elongated apparatuses with at least one said external entity further comprising the step of:

connecting the modular elongated element (1) of a first one of said modular elongated apparatuses proximate at least one of its said ends (14) with at least one other of said modular elongated apparatuses.

32. The method of claim 31, said step of connecting said modular elongated element (1) of said first one of said modular elongated apparatuses proximate at least one of its said ends (14) with at least one other of said modular elongated apparatuses further comprising the step of:

connecting said modular elongated element (1) proximate both of its said ends (14) with at least one other of said modular elongated apparatuses.

33. The method of claim 31, further comprising the step of:

differing a length of at least one of said modular elongated apparatuses from a length of at least one other of said modular elongated apparatuses.

34. The method of claim 33, further comprising the step of:

differing the length of said at least one of said modular elongated apparatuses from the length of said at least one other of said modular elongated apparatuses by a factor of $\sqrt{n}$, where n is any integer greater than 1.

35. The method of claim 31, the steps of connecting said modular elongated element (1) of said first one of said modular elongated apparatuses with at least one other of said modular elongated apparatuses further comprising the step of:

connecting said modular elongated element (1) proximate said at least one of its said ends (14) with a plurality of other said modular elongated apparatuses.

36. The method of claim 31, said step of connecting said modular elongated element of said first one of said modular elongated apparatuses with said at least one other said modular elongated apparatus further comprising the step of:

connecting together at least one of the first securing and linking means (12) and the second securing and linking means (12) of said first one of said modular elongated apparatuses with at least one securing and linking means (12) of said at least one other of said modular elongated apparatuses.

37. The method of claim 36, further comprising the step of:

connecting the securing and linking means (12) of the first modular elongated apparatus with said securing and linking means (12) of said at least one other of said modular elongated apparatuses, using intermodule connector means (13) for connecting the first modular elongated apparatus with the at least one other modular elongated apparatus.

38. The method of claim 31, said step of connecting said modular elongated element (1) of said first one of said modular elongated apparatuses with said at least one other of said modular elongated apparatuses further comprising the step of:

substantially fixing an angle among said modular elongated element (1) and said at least one other said modular elongated apparatus, using at least one fixed angle joint connection means (120) connected therebetween for substantially fixing angles among at least two adjacent modular elongated elements (1).

39. The method of claim 31, further comprising the step of:

flexibly connecting together (1801) at least one pair of said modular elongated apparatuses proximate a point between the said first ends (14) and second ends (14) thereof.

40. The method of claim 39, further comprising the step of:

connecting an end (14) of a least one of said modular elongated apparatuses proximate the flexible connection (1801).

41. The method of claim 25, further comprising the step of:

containing the first securing and linking means (12), the second securing and linking means (12), and the intramodule tensile means (11) of at least one of said modular elongated apparatuses, substantially within said interior of the modular elongated element (1) of said at least one of said modular elongated apparatuses.

42. The method of claim 25, further comprising the step of:

drawing said securing and linking means (12) of at least one of said modular elongated apparatuses away from its said modular elongated element (1), using connecting and drawing facilitation means (61) for drawing said securing and linking means (12) away from its modular elongated element (1) to facilitate linking its intramodule tensile means (11) with said external entities.

43. The method of claim 25, further comprising the step of:

adjusting a length of the modular elongated element (1) of at least one of said modular elongated apparatuses, using length adjustment means thereof for adjusting said length of said modular elongated element (1).

44. The method of claim 25, further comprising the step of:

providing said tensile pull of at least one of said modular elongated apparatuses by said intramodule tensile means (11) comprising an inherently-tensile device providing said tensile pull.

45. The method of claim 25, further comprising the step of:

mechanically drawing together the ends of said intramodule tensile means (11) of at least one of said modular elongated apparatuses, to provide said tensile pull.

46. The method of claim 45, further comprising the step of:

remotely controlling said intramodule tensile means (11) to mechanically draw together said ends of said intramodule tensile means (11).

47. The method of claim 25, said at least one modular elongated apparatus comprising a plurality of said modular elongated apparatuses, further comprising the step of:

flexibly connecting together (1801) at least one pair of said modular elongated apparatuses proximate a point between the said first ends (14) and second ends (14) thereof.

48. The method of claim 47, said step of flexibly connecting together (1801) at least one pair of said modular elongated apparatuses further comprising the step of:

flexibly connecting at least one of said modular elongated apparatuses substantially proximate a midpoint thereof.

49. An inherently-tensile, modular elongated apparatus comprising an elementary tensile skeleton, said elementary tensile skeleton consisting of:

intramodule tensile means (11) for providing tensile pull;

a modular elongated element (1);

first securing and linking means (12) for the three combined functions of securing a first end of said intramodule tensile means (11) to a first end (14) of said modular elongated element (1), maintaining said intramodule tensile means (11) in an accessible state for when it is desired to link said first end of said intramodule tensile means (11) with a first external entity, and linking said first end of said intramodule tensile means (11) with said first external entity;

second securing and linking means (12) for the three combined functions of securing a second end of said intramodule tensile means (11) to a second end (14) of said modular elongated element (1), maintaining said intramodule tensile means (11) in an accessible state for when it is desired to link said second end of said intramodule tensile means (11) with a second external entity, and linking said second end of said intramodule tensile means (11) with said second external entity; and an intramodule tensile connection between said first securing and linking means (12) and said second securing and linking means (12) via said intramodule tensile means (11), thereby drawing said first securing and linking means (12) and said second securing and linking means (12) toward one another, under said tensile pull; wherein:

when said modular elongated element (1) is not connected proximate its said first and second ends (14) with said first and second external entities, said intramodule tensile means (11) runs lengthwise, and connects said first securing and linking means (12) and said second securing and linking means (12), through an interior of said modular elongated element (1);

when said modular elongated element (1) is not connected proximate its said first end (14) with said first external entity, said first end of said intramodule tensile means (11) is secured via said first securing and linking means (12) to said first end (14) of said modular elongated element (1), and, simultaneously, said first securing and linking means (12) is secured to said first end of said modular elongated element (1), all under and by virtue of said tensile pull; and when said modular elongated element (1) is not connected proximate its said second end (14) with said second external entity, said second end of said intramodule tensile means (11) is secured via said second securing and linking means (12) to said second end (14) of said modular elongated element (1), and, simultaneously, said second securing and linking means (12) is secured to said second end of said modular elongated element (1), all under and by virtue of said tensile pull.

50. A method of making inherently tensile, an inherently-tensile, modular elongated apparatus, comprising the step of establishing an elementary tensile skeleton for said modular elongated apparatus, said step of establishing said elementary tensile skeleton consisting of the steps of:

running said intramodule tensile means (11) lengthwise through an interior of said modular elongated element (1);

intramodularly connecting via said intramodule tensile means (11), and thereby drawing toward one another, through said interior of said modular elongated element (1), under said tensile pull:

first securing and linking means (12) for the three combined functions of securing a first end of said intramodule tensile means (11) to a first end (14) of a modular elongated element (1), maintaining said intramodule tensile means (11) in an accessible state for when it is desired to link said first end of said intramodule tensile means (11) with a first external entity, and linking said first end of said intramodule tensile means (11) with said first external entity; and second securing and linking means (12) for the three combined functions of securing a second end of said intramodule tensile means (11) to a second end (14) of said modular elongated element (1), maintaining said intramodule tensile means (11) in an accessible state for when it is desired to link said second end of said intramodule tensile means (11) with a second external entity, and linking said second end of said intramodule tensile means (11) with a second external entity;

not-connecting said modular elongated element (1) proximate its said first end (14) with said first external entity, by securing said first end of said intramodule tensile means (11) via said first securing and linking means (12) with said first end (14) of said modular elongated element (1), and, simultaneously, securing said first securing and linking means (12) to said first end of said modular elongated element (1), all under and by virtue of said tensile pull; and not-connecting said modular elongated element (1) proximate its said second end (14) with said second external entity, by securing said second end of said intramodule tensile means (11) via said second securing and linking means (12) with said second end (14) of said modular elongated element (1), and, simultaneously, securing said second securing and linking means (12) to said second end of modular elongated element (1), all under and by virtue of said tensile pull.

* * * * *